US006313389B1

(12) United States Patent
Adachi

(10) Patent No.: US 6,313,389 B1
(45) Date of Patent: Nov. 6, 2001

(54) AUTOMATIC ACCOMPANIMENT APPARATUS ADJUSTING SOUND LEVELS FOR EACH PART OF A PLURALITY OF PATTERNS WHEN ONE PATTERN IS SWITCHED TO ANOTHER PATTERN

(75) Inventor: Yoshihisa Adachi, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 09/558,500

(22) Filed: Apr. 26, 2000

(30) Foreign Application Priority Data

Apr. 30, 1999 (JP) ..... 11-123678

(51) Int. Cl.[7] ..... G10H 1/36; G10H 1/38

(52) U.S. Cl. ..... 84/634; 84/637; 84/666; 84/669; 84/DIG. 22

(58) Field of Search ..... 84/609–614, 634–638, 84/649–652, 666–669, DIG. 12, DIG. 22

(56) References Cited

U.S. PATENT DOCUMENTS 5,831,195 * 11/1998 Nakata ..... 84/609

* cited by examiner

*Primary Examiner*—Stanley J. Witkowski
(74) *Attorney, Agent, or Firm*—Christie, Parker & Hale, LLP

(57) ABSTRACT

An automatic accompaniment apparatus has a storage unit (53) for storing information on a variation pattern selection state and the mute setup state of each part of each variation, and a control unit (55) for controlling to make each part in a tone generation state or a mute state in accordance with the mute setup state of the part of the selected variation pattern in playing an insert pattern such as an introduction pattern, a fill-in pattern, and an ending pattern. The mute setup state set for the selected variation pattern is applied without change also to the insert pattern, thus preventing the mute setup state of each part from changing at the time of switching between the variation pattern and the insert pattern, and obtaining smooth automatic accompaniment tones.

10 Claims, 7 Drawing Sheets

FIG. 5A

| | | | |
|---|---|---|---|
| VARI4 | | MUTE | |
| VARI3 | | | |
| VARI2 | | | MUTE |
| VARI1 | MUTE | | |
| | DRUM | BASS | CHORD |

FIG. 5B

| |
|---|
| VARI1 |

AUTOMATIC ACCOMPANIMENT APPARATUS ADJUSTING SOUND LEVELS FOR EACH PART OF A PLURALITY OF PATTERNS WHEN ONE PATTERN IS SWITCHED TO ANOTHER PATTERN

BACKGROUND OF THE INVENTION

1. Field of the Invention

The present invention relates to automatic accompaniment apparatus, particularly to automatic accompaniment apparatus having an automatic accompaniment function of various insert patterns such as an introduction pattern, a fill-in pattern, and an ending pattern, in addition to a basic pattern.

2. Description of the Related Art

Normally, an automatic accompaniment apparatus of an electronic musical instrument obtains accompaniment tones on the basis of accompaniment pattern data prepared in advance. Some conventional automatic accompaniment apparatus have a function capable of inserting various patterns such as an introduction pattern, a fill-in pattern, and an ending pattern, in addition to a basic pattern as accompaniment pattern data. Also, some other apparatus can provide variations of a basic pattern, and can individually mute, e.g., a drum part, a bass part, a chord part, etc., in each variation pattern.

More specifically, an automatic accompaniment apparatus of this type has operation members for respectively muting drum, bass, and chord parts in the basic pattern, and can individually set the individual part in a tone generation or mute state. Also, upon playing the basic pattern in which mute setup states are set by these operation members in units of parts, accompaniment tones can be produced in various expressions by designating an introduction pattern, a fill-in pattern, an ending pattern, etc.

However, in the conventional automatic accompaniment apparatus, even when a mute state is set for a given part in a certain variation pattern, if a pattern such as an introduction pattern, a fill-in pattern, an ending pattern, is inserted in such a state, the mute setup of the variation pattern is not reflected in the play of such an insert pattern, and preset accompaniment pattern data are played.

For this reason, even though drum tones are muted and not produced while playing a variation pattern, drum tones begin to be produced as soon as a pattern such as a fill-in pattern is inserted. Upon completion of the play of a fill-in pattern, the variation pattern restarts to mute drum tones, thus disturbing a natural play.

SUMMARY OF THE INVENTION

It is an object of the present invention to attain a smooth play by preventing the mute setup states of respective parts from changing upon switching between a basic pattern (variation pattern), and an insert pattern such as an introduction pattern, a fill-in pattern, and an ending pattern.

An automatic accompaniment apparatus according to the present invention having a function of making automatic accompaniment of an insert pattern in addition to a basic pattern, comprises variation selection means for selecting desired one out of variation patterns prepared as said basic pattern; mute setting means for individually setting a mute setup state of each part for each of said variation patterns; instruction means for giving instructions to play said insert pattern; and control means for controlling to make each part in a tone generation state or a mute state in accordance with the mute setup state of the part of the selected variation pattern in playing said insert pattern.

The apparatus may further comprise storage means for storing at least information on the selection state of said variation patterns and the mute setup state of each part, wherein said control means may control tone generation of each part with reference to information stored in said storage means in receiving instructions to play said insert pattern.

According to the present invention with the above arrangement, even when a pattern such as an introduction pattern, a fill-in pattern, and an ending pattern, is inserted during an automatic accompaniment while a given part in a certain variation pattern is muted, the mute setup state of each part in the variation pattern so far is reflected in the insert pattern in the actual play. Besides, when the play of the insert pattern comes to an end, and the variation pattern restarts, the play can be switched without changing the mute setup states of parts. In this manner, the mute setup state of each part can be prevented from changing upon switching between the variation pattern and the insert pattern, and the user can enjoy a smoother automatic accompaniment.

BRIEF DESCRIPTION OF THE DRAWINGS

FIGS. 5A and 5B are charts showing some storage areas of the RAM shown in FIG. 2;

DETAILED DESCRIPTION OF THE PREFERRED EMBODIMENTS

An embodiment of the present invention will be described hereinafter with reference to the accompanying drawings.

Figure 1:
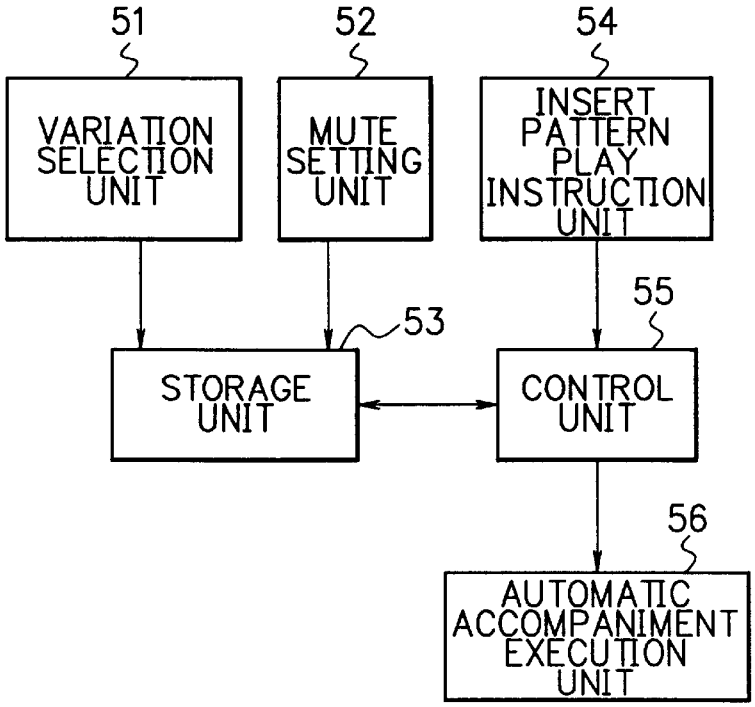
FIG. 1 is a block diagram showing a functional construction as an elementary feature of an automatic accompaniment apparatus according to the present invention.

FIG. 1 is a block diagram showing a functional construction as an elementary feature of an automatic accompaniment apparatus according to the present invention. Referring to FIG. 1, reference numeral 51 denotes a variation selection unit for selecting a desired one of variation patterns prepared in advance as accompaniment pattern data of a basic pattern. Reference numeral 52 denotes a mute setting unit for individually setting mute setup states of parts such as a drum part, a bass part, and a chord part, in units of variation patterns.

Reference numeral 53 denotes a storage unit for storing at least information that pertains to the selection state of a variation pattern by the variation selection unit 51, and the mute setup states of each variation pattern in units of parts by the mute setting unit 52. Reference numeral 54 denotes an insert pattern play instruction unit for selecting an insert pattern such as an introduction pattern, a fill-in pattern, an ending pattern, and instructing to play the selected pattern.

Reference numeral 55 denotes a control unit for controlling to set individual parts in a tone generation state or a mute state in accordance with the mute setup states of the individual parts associated with a variation pattern currently selected by the variation selection unit 51 upon playing an insert pattern as well as playing the variation pattern. That is, when the insert pattern play instruction unit 54 instructs to play a given insert pattern, the control unit 55 controls tone generation of the individual parts with reference to the information stored in the storage unit 53. Reference numeral 56 denotes an automatic accompaniment execution unit for executing an automatic accompaniment in the mute states of the individual parts controlled by the control unit 55.

Figure 2:
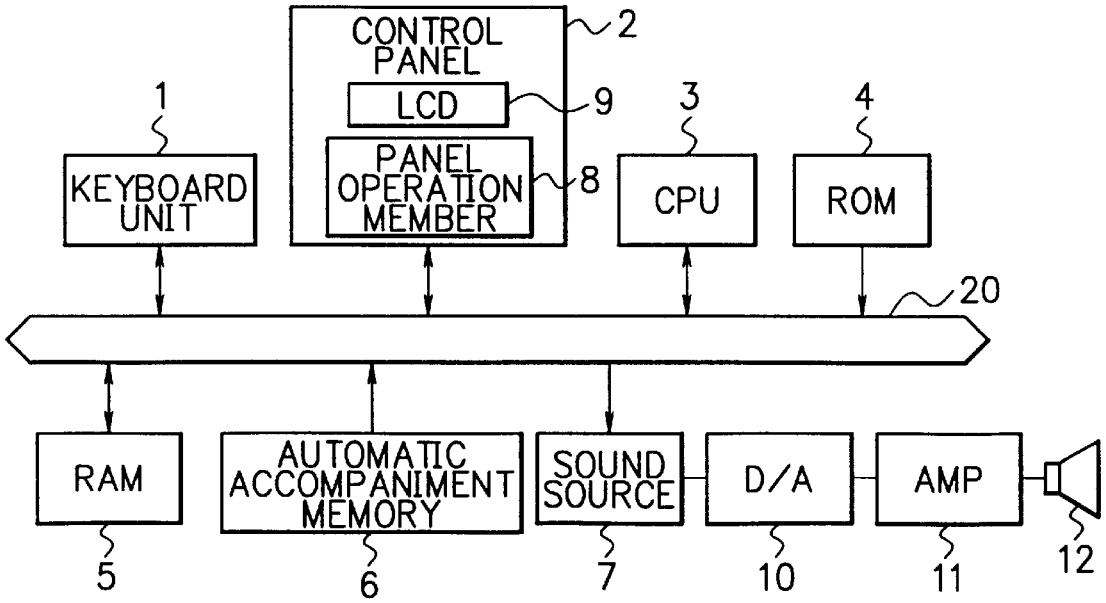
FIG. 2 is a block diagram showing an example of the overall construction of an electronic musical instrument including the automatic accompaniment apparatus according to the present invention.

FIG. 2 is a block diagram showing an example of the overall construction of an electronic musical instrument that includes the automatic accompaniment apparatus having the functions shown in FIG. 1.

In the electronic musical instrument of this embodiment, accompaniment tones of the basic pattern or the insert pattern such as an introduction pattern, a fill-in pattern, and an ending pattern, are produced by a microcomputer.

Referring to FIG. 2, a keyboard unit 1, a control panel 2, a CPU 3, a ROM 4, a RAM 5, an automatic accompaniment memory 6, and a sound source 7 are connected to a bus line 20 including a data bus, an address bus, etc., and can exchange data with each other.

The keyboard 1 comprises one or more keyboards each including keys and key switches provided in accordance with those keys. Each key switch can detect ON and OFF key events, and can also detect the operation speed of the corresponding key. In a multi-keyboard instrument (e.g., an electronic organ) having keyboards, one of keyboards is used to designate chord progression of an automatic accompaniment. On the other hand, in a single-keyboard instrument (e.g., a keyboard), some keys of the keyboard are used to designate chord progression of an automatic accompaniment.

The control panel 2 has panel operation members 8, and a liquid crystal display (LCD) 9. The panel operation members 8 include operation members for setting various parameters required upon automatic accompaniment based on accompaniment pattern data, which are preset or set by the user, in addition to operation members for setting various kinds of tone parameter information (tone color, tone volume, effect, etc.) required for the user to play. The LCD 9 displays setup states and the like of these operation members.

The operation members used upon automatic accompaniment include an operation member for selecting a desired one of variation patterns prepared as automatic accompaniment data of the basic pattern, an operation member for individually setting the mute setup states of parts such as a drum part, a bass part, and a chord part, in units of variation patterns, an operation member for selecting various insert patterns such as an introduction pattern, a fill-in pattern, and an ending pattern, and instructing to play the selected pattern, and the like, in addition to an operation member for selecting a rhythm style such as waltz, rock, or tango, and an operation member for instructing to start/stop automatic accompaniment. Therefore, the panel operation members 8 include the variation selection unit 51, the mute setting unit 52, and the insert pattern play instruction unit 54 shown in FIG. 1.

The CPU 3 scans the respective key switches of the keyboard unit 1 and the panel operation members 8 on the control panel 2 to detect the operation states (ON or OFF key events, key numbers of ON keys, velocities associated with the operation speeds (magnitudes of tones to be produced) of ON keys, and the like) of the respective keys on the keyboard unit 1, and those of the panel operation members 8 on the control panel 2, and executes the following processes in accordance with the operations of the keys and operation members, in accordance with programs stored in the ROM 4.

For example, the CPU 3 obtains accompaniment tone data to be produced on the basis of chord information detected based on key operations on the keyboard unit 1, while reading out automatic accompaniment pattern data corresponding to a variation pattern or an insert pattern selected by the operation members on the control panel 2 from the automatic accompaniment memory 6. The CPU 3 then supplies the obtained accompaniment tone data to the sound source 7 to form and output the corresponding accompaniment tone signals.

Upon receiving a play instruction based on the insert pattern, the CPU 3 also controls to set the individual parts such as a drum part, a bass part, and a chord part, in a tone generation state or a mute state in accordance with the mute setup states of the individual parts of the currently selected variation pattern. Therefore, the CPU 3 corresponds to the control unit 55 shown in FIG. 1. The processes of the CPU 3 will be described in detail later.

The automatic accompaniment memory 6 stores several kinds of automatic accompaniment pattern data used upon automatic accompaniment as preset data. Sets of automatic accompaniment pattern data are stored in units of rhythm styles such as waltz, rock, an tango, in units of parts such as a drum part, a bass part, and a chord part, and in units of patterns such as a basic pattern, an introduction pattern, a fill-in pattern, and an ending pattern. The basic pattern further includes variation patterns.

Figure 3:
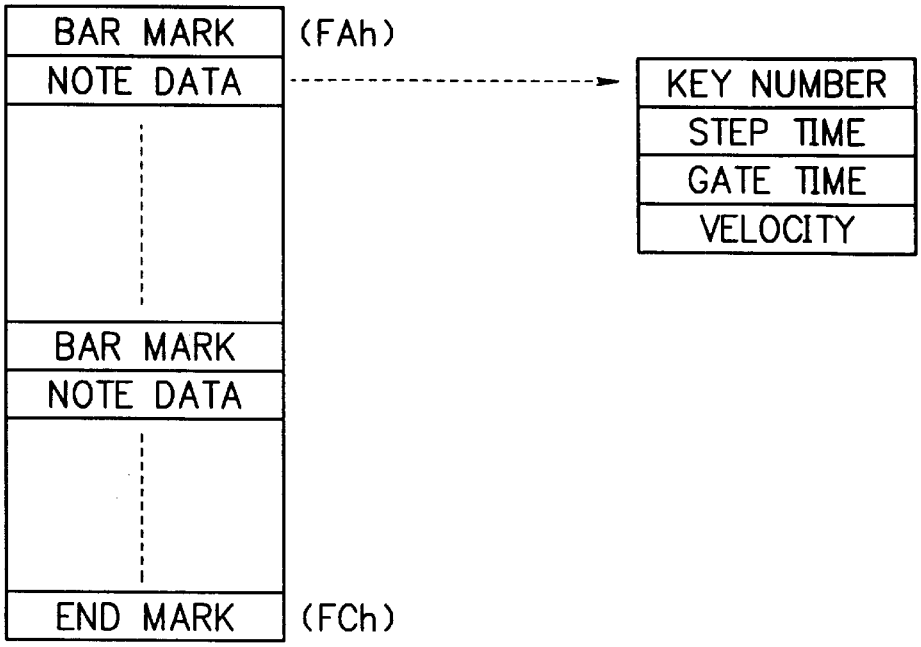
FIG. 3 is a chart showing the format of automatic accompaniment data.

Each automatic accompaniment pattern data includes bar marks each indicating the head of a given bar, note data as note information of notes to be produced, and an end mark indicating the end of accompaniment pattern data, as shown in FIG. 3. Each note data consists of a key number for specifying the type of key, a step time indicating a tone generation timing, a gate time indicating a tone generation duration, and a velocity indicating an ON key speed. When the automatic accompaniment pattern data is read out in turn from the first bar mark and the end mark is reached, it returns to the first bar mark again to continue automatic accompaniment.

The ROM 4 stores various required data in addition to programs that store various processing sequences of the CPU 3, and waveform data based on which tone signals are generated. The ROM 4 and the automatic accompaniment memory 6 are individually provided, but the ROM 4 may store various automatic accompaniment pattern data.

The RAM 5 has storage areas for temporarily storing various kinds of information during execution of various processes by the CPU 3, and storing information obtained as a result of various processes. Furthermore, the RAM 5 has a storage area for storing information such as various kind of states set upon operation of the panel operation members 8, that is, at least information pertaining to the currently selected variation pattern, and the mute setup states of the individual parts of each pattern. The RAM 5 corresponds to the storage unit 53 shown in FIG. 1.

The sound source 7 corresponds to the automatic accompaniment execution unit 56 shown in FIG. 1, and comprises n tone generation channels to be able to produce tones at the same time. In this manner, not only automatic accompaniment tones of drum, bass, and chord parts can be simultaneously produced, but also these automatic accompaniment tones and tones played by the player upon operating the keyboard 1 can be simultaneously produced.

The sound source 7 generates a tone signal on the basis of note data sent from the CPU 3, tone parameter information set upon operation of the panel operation members 8, and the like. More specifically, the sound source 7 generates a waveform read address on the basis of key number information in the note data, and reads out tone waveform data from the ROM 4 in accordance with the generated address. The sound source 7 then processes the readout tone waveform data using envelope information, and outputs the processed result to a D/A converter 10. A tone signal output from the D/A converter 10 is amplified by an amplifier 11, and is supplied to a loudspeaker 12.

Figure 4:
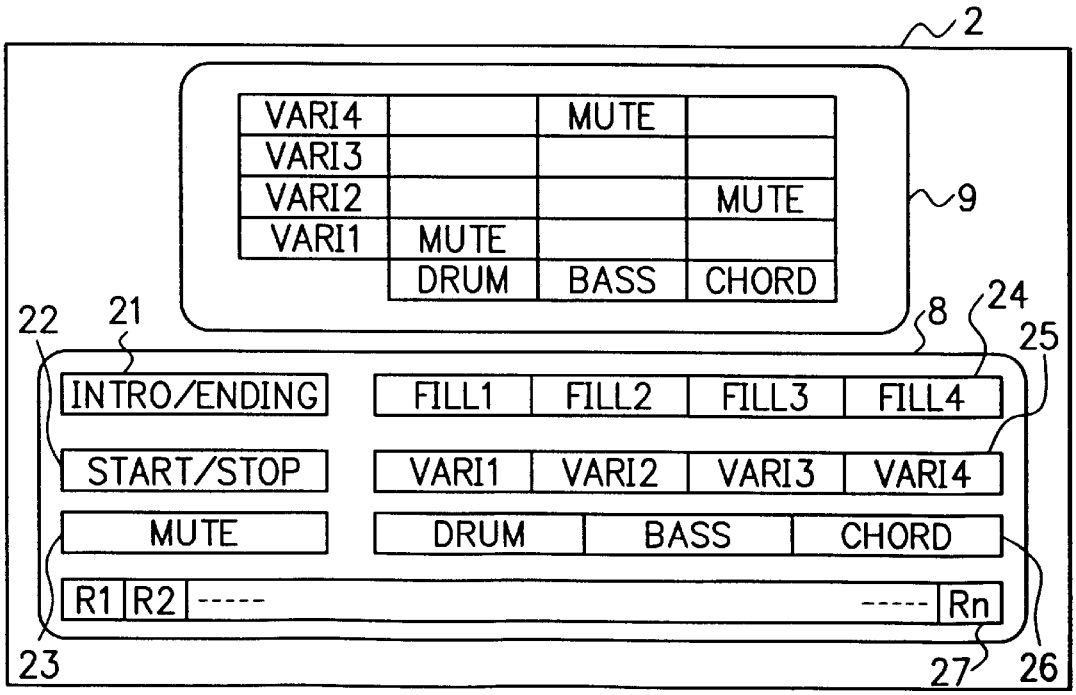
FIG. 4 is a diagrammatic view showing part of a specific construction of the control panel shown in FIG. 2.

FIG. 4 is a diagrammatic view showing part of a specific construction of the above control panel 2. FIG. 4 does not illustrate operation members for setting various kinds of tone parameter information (tone color, tone volume, effect, etc.), and illustrates only an operation member group used upon automatic accompaniment, as the panel operation members 8. The automatic accompaniment operation member group includes an introduction/ending switch 21, a start/stop switch 22, a mute setting switch 23, fill-in switches 24, variation switches 25, part switches 26, and rhythm select switches 27.

The variation switches 25 are operation members used to select a desired one of variation patterns (four patterns VARI1 to VARI4 in the example shown in FIG. 4) prepared in advance as automatic accompaniment data of the basic pattern, and correspond to the variation selection unit 51 shown in FIG. 1. More specifically, the basic pattern includes variation patterns to improve the power of expression of a performance, and an arbitrary one of these patterns can be selected using the variation switches 25.

The fill-in switches 24 are operation members used to select a desired one of fill-in patterns (fill-in patterns FILL1 to FILL4 that respectively match the four variation patterns VARI1 to VARI4 in the example shown in FIG. 4) prepared in advance, and instruct to play the selected pattern. The fill-in switches 24 serve as some building components of the insert pattern play instruction unit 54 shown in FIG. 1. More specifically, those having identical numbers of the patterns VARI1 to VARI4 and FILL1 to FILL4 correspond to each other.

The introduction/ending switch 21 is an operation member used to instruct to play an introduction or ending pattern, and serves as one building component of the insert pattern play instruction unit 54 shown in FIG. 1. Upon operation of this switch at the beginning of automatic accompaniment, an introduction pattern is played, and the variation pattern selected upon operation of one of the variation switches 25 starts. Upon operation of this introduction/ending switch 21 in the middle of a play, the play automatically stops after accompaniment tones of the ending pattern are produced.

The start/stop switch 22 is an operation member used to instruct to start/stop automatic accompaniment. Also, the rhythm select switches 27 are used to select a desired one of n rhythm styles R1 to Rn prepared in advance as automatic accompaniment pattern data.

The mute setting switch 23 and the part switches 26 are operation members used to set individually the mute setup states of the individual parts such as a drum part, a bass part, and a chord part, in units of variation patterns, and correspond to the mute setting unit 52 shown in FIG. 1. When the mute setting switch 23 is operated while a desired variation pattern is selected by a given variation switch 25, and a desired part is selected by a given part switch 26, the selected part of that variation is set in a mute state. On the other hand, when the mute setting switch 23 is operated when the selected part is in the mute state, that mute state is canceled.

The LCD 9 displays the setup states using the switches 21 and 27. For example, as shown in FIG. 4, parts set in a mute state are displayed in units of variation patterns. In the example shown in FIG. 4, the drum part of the variation pattern VARI1, the chord part of the variation pattern VARI2, and the base part of the variation pattern VARI4 are set in a mute state.

FIGS. 5A and 5B are charts showing some storage areas of the above RAM 5. As described above, the RAM 5 of this embodiment has a storage area for storing information of states set upon operations of the switches 21 to 27 shown in FIG. 4, a storage area (FIG. 5A) for storing information of the mute setup states set in units of parts of the respective variation patterns, and a storage area (FIG. 5B) for storing information of the currently selected variation pattern. Storage areas shown in FIG. 5A are in units of rhythm styles.

The operation as a characteristic feature of the present invention done by the CPU 3 will be explained below.

Before starting a play, a desired rhythm style is selected using the rhythm select switch 27, and a desired variation pattern is selected using the variation switches 25. Also, automatic accompaniment tones to be produced or muted are set in units of parts of each variation pattern using the mute setting switch 23 and the part switches 26. These setup states are stored and saved in the RAM 5.

When an insert pattern such as an introduction pattern, a fill-in pattern, or an ending pattern, is to be played at the beginning of or after the start of the play in such setup states, the introduction/ending switch 21 or one of the fill-in switches 24 is operated to select a desired insert pattern. Then, accompaniment pattern data corresponding to the pressed switch is read out from the automatic accompaniment memory 6, and undergoes a mute process to be described below so as to produce actual tones.

More specifically, the CPU 3 loads the information stored in the RAM 5, as shown in FIGS. 5A and 5B, and produces tones while muting tones of the part or parts set in the loaded information. The mute setup information that the CPU 3 refers to at that time is associated with the currently selected variation pattern. That is, the CPU 3 loads the mute setup state associated with the variation pattern stored in the storage area shown in FIG. 5B from the storage area shown in FIG. 5A, and plays an insert pattern in accordance with the loaded contents.

In this embodiment, not only mute setup states are set in units of parts using the panel operation members 8 shown in FIG. 2 while displaying them on the LCD 9 when automatic accompaniment is not made (played), but also they can be set in real time when automatic accompaniment is in progress (being played). A mute setup when no automatic accompaniment is made (played) will be referred to as "first mute setup" hereinafter, and that during automatic accompaniment will be referred to as "second mute setup" hereinafter.

Since the LCD 9 is used to display other parameters (e.g., rhythm style name, tempo speed, etc.) during automatic accompaniment, the mute setup states of the drum, bass, and chord parts are indicated by the part switches 26 shown in FIG. 4. That is, the part switches 26 have light-emitting elements such as LEDs in addition to switch portions. The mute setup state during play is inverted by operating each part switch 26, and its contents are immediately indicated by the corresponding LED. For example, when a mute state is set, the LED is turned on; otherwise, it is turned off.

Figure 6:
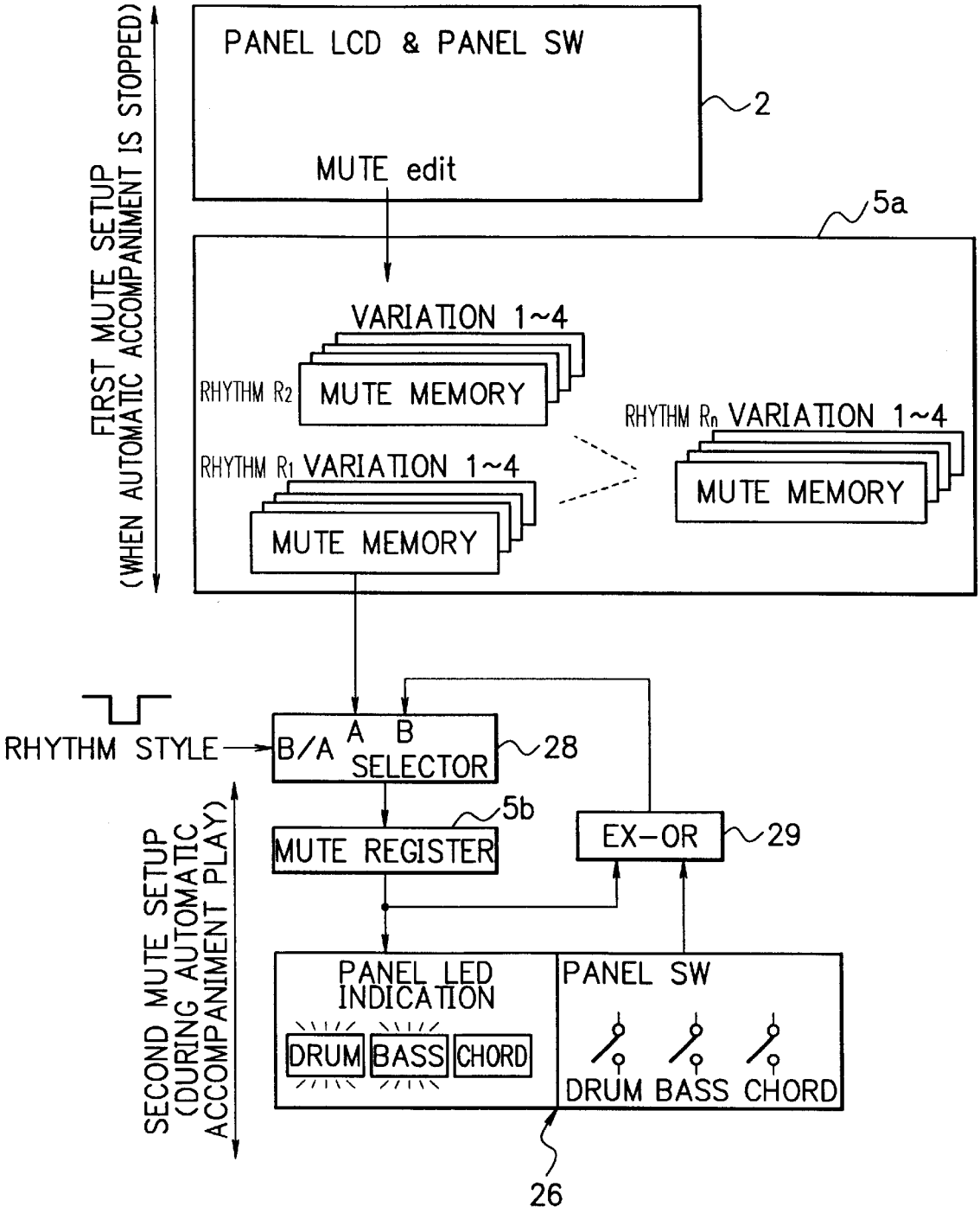
FIG. 6 is a chart for explaining first and second mute setups.

FIG. 6 is a chart for explaining the above first and second mute setups in detail. Referring to FIG. 6, when the first mute setup is made while automatic accompaniment is stopped, mute setup states are set for the individual parts of each variation pattern in units of rhythm styles R1 to Rn using the panel operation members 8 (more specifically, the mute setting switch 23, the variation switches 25, the part switches 26, and the rhythm select switches 27) while displaying the setup results on the LCD 9. These setup states are stored and saved in a mute memory 5*a* as one storage area of the RAM 5.

After that, when a desired variation pattern of a desired rhythm style is selected, information of the mute setup state corresponding to the selected variation pattern is read out from the mute memory 5*a*. The information of the mute setup state is set in a mute register 5*b*, a storage area in the RAM 5, via a selector 28. The LEDs corresponding to the drum, bass, and chord parts of the part switches 26 are indicated in accordance with the mute setup state set in the mute register 5*b*.

Upon operating the start/stop switch 22 in this state, an automatic accompaniment play of the selected variation pattern is started, and the individual parts are muted or not muted in accordance with the mute setup state set in the mute register 5*b*. The information of the mute setup state set in the mute register 5*b* is supplied to an EX-OR gate 29 together with the outputs from the switch portions corresponding to the drum, bass, and chord parts of the part switches 26.

The EX-OR gate 29 computes the EX-OR of the mute setup state information of each part supplied from the mute register 5*b*, and operation information of the switch portion of each part supplied from the part switches 26 independently in units of parts. The EX-OR gate feeds the computation back to the mute register 5*b* via the selector 28. The selector 28 selectively outputs the feedback input on the side of terminal B unless it is triggered by, e.g., a change in rhythm style.

In this manner, when the second mute setup is made during execution of the automatic accompaniment play, a desired one of the drum, bass, and chord part switches of the part switches 26 can be operated. The mute setup state of the part corresponding to the operated switch is inverted by the EX-OR gate 29, and is stored in the mute register 5*b*. The LED indications of the part switches 26 are done in accordance with a new mute setup state set in the mute register 5*b*, and the corresponding part of the automatic accompaniment data is muted or not muted.

Execution of automatic accompaniment based on the variation pattern has been explained. Also, when an insert pattern such as an introduction pattern, a fill-in pattern, or an ending pattern, is instructed to play, the mute setup state information stored in the mute register 5*b* is loaded, and the insert pattern is played in accordance with the loaded contents. That is, the mute register 5*b* always stores information used to control the mute setup states of the individual parts in real time during the automatic accompaniment play.

With the aforementioned arrangement, even when a pattern such as an introduction pattern, a fill-in pattern, or an ending pattern, is inserted during the automatic accompaniment play while a given part of a certain variation pattern is muted, the insert pattern is played to reflect the mute setup states of the individual parts set in the variation pattern so far. When the previous variation pattern restarts upon completion of the play of the insert pattern, they can be switched without changing the mute setup states of the individual parts.

For example, as shown in FIG. 4 or FIGS. 5A and 5B, when the corresponding fill-in pattern FILL1 is started during the play of the variation pattern VARI1 in which drum tones are muted, drum tones are also muted in the play of the fill-in pattern FILL1, and the variation pattern VARI1 restarts upon completion of the play of the fill-in pattern FILL1. That is, the drum tones are kept muted throughout the play of the variation pattern VARI1 and fill-in pattern FILL1.

On the other hand, even when the player with starts one the other fill-in patterns FILL2 to FILL4 during the play of the variation pattern VARI1, since the selected fill-in pattern is played in accordance with the mute setup state of the variation pattern VARI1 selected at that time (stored in the storage area shown in FIG. 5B), drum tones are muted during the play of one of those fill-in patterns FILL2 to FILL4, and the variation pattern VARI1 restarts upon completion of the play of the selected fill-in pattern.

Upon instructing to insert an introduction pattern at the beginning of the play, the introduction pattern is played in accordance with the mute setup state pertaining to the variation pattern VARI1 selected in advance (stored in the storage area shown in FIG. 5B), and the play of the selected variation pattern VARI1 starts upon completion of the play of the introduction pattern. In this case as well, the drum tones are kept muted throughout the play of the introduction pattern and variation pattern VARI1.

Figure 7:
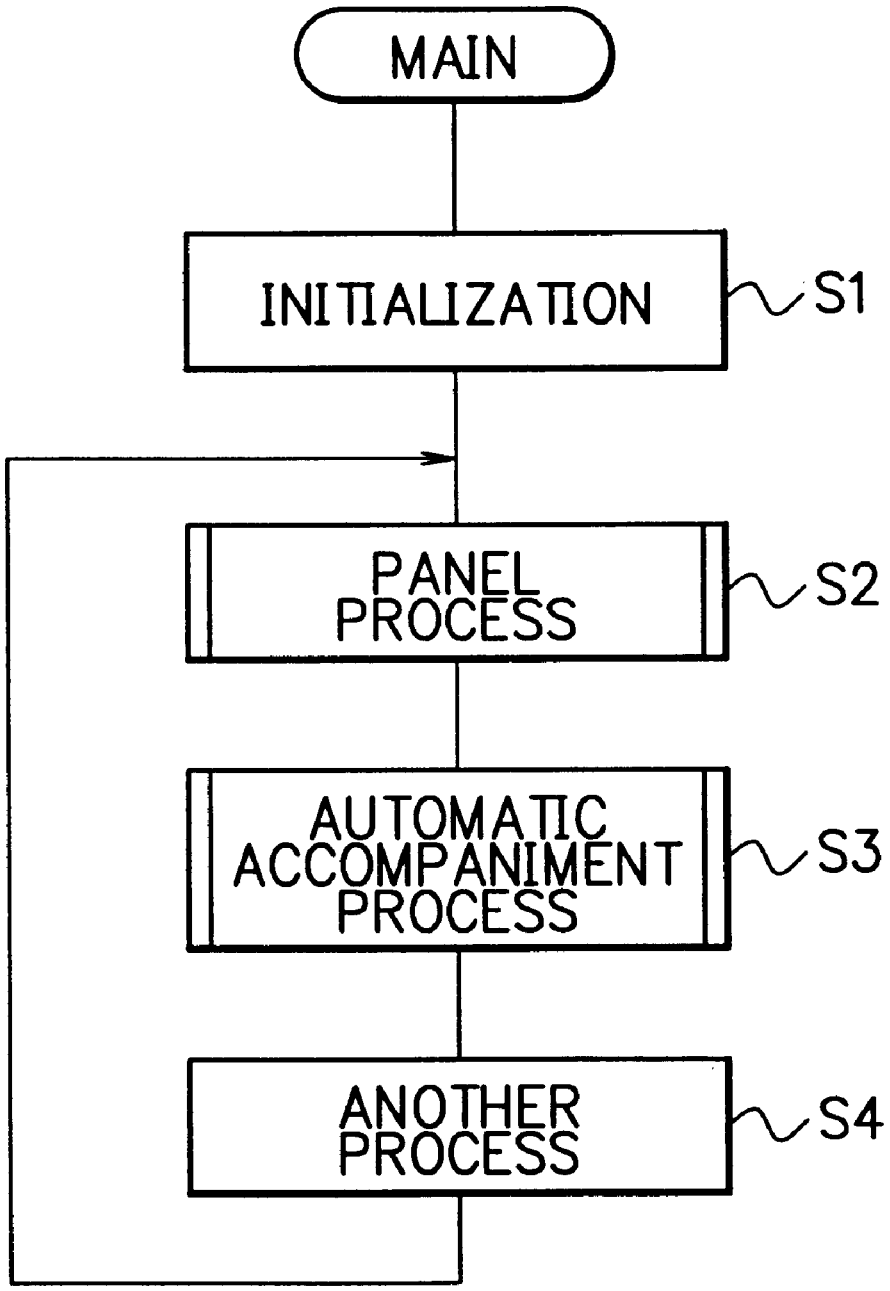
FIG. 7 is a flowchart showing a main routine executed by the automatic accompaniment apparatus according to an embodiment of the present invention.
Figure 8:
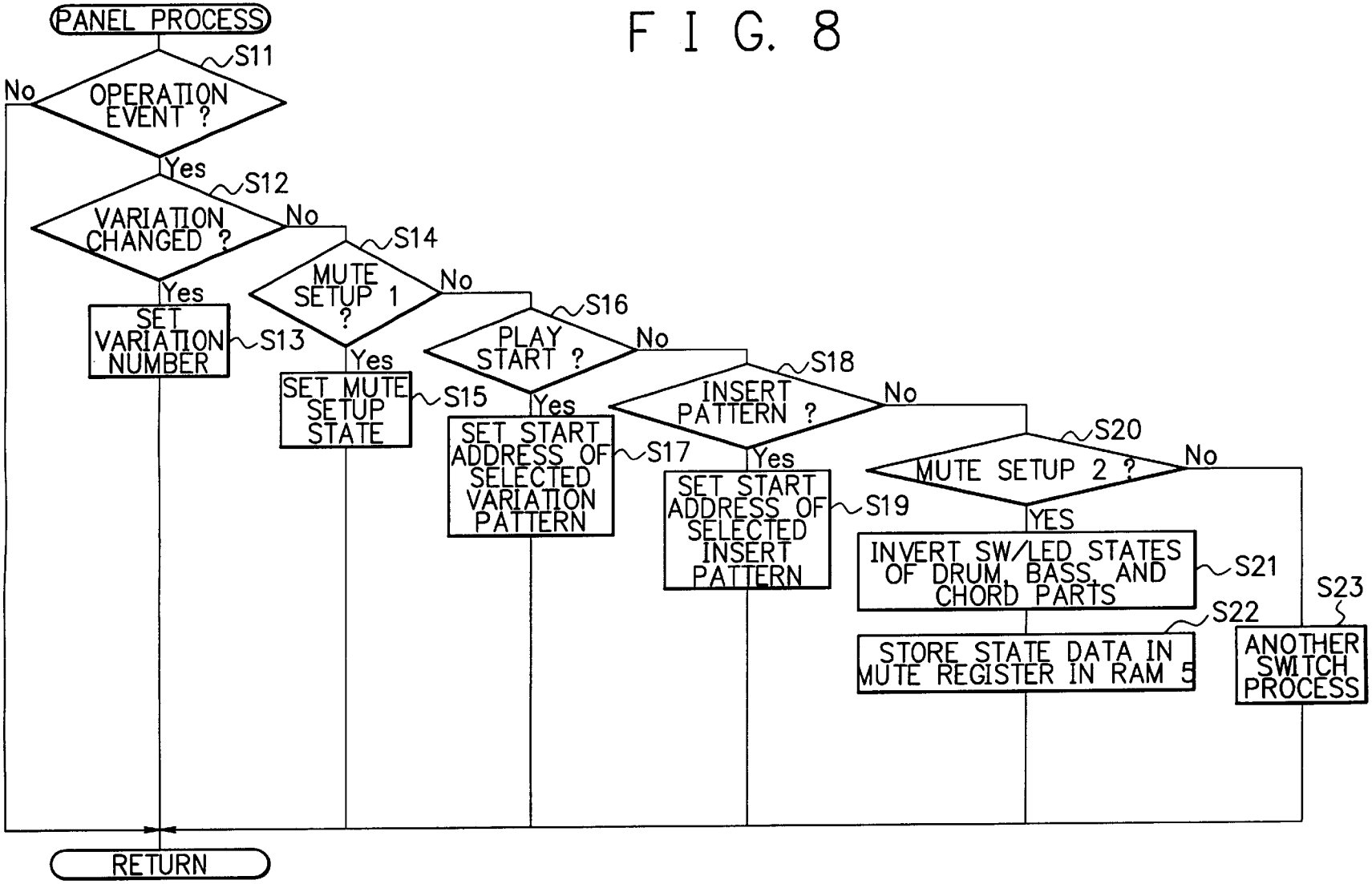
FIG. 8 is a flowchart showing a panel process executed by the automatic accompaniment apparatus according to the embodiment of the present invention.
Figure 9:
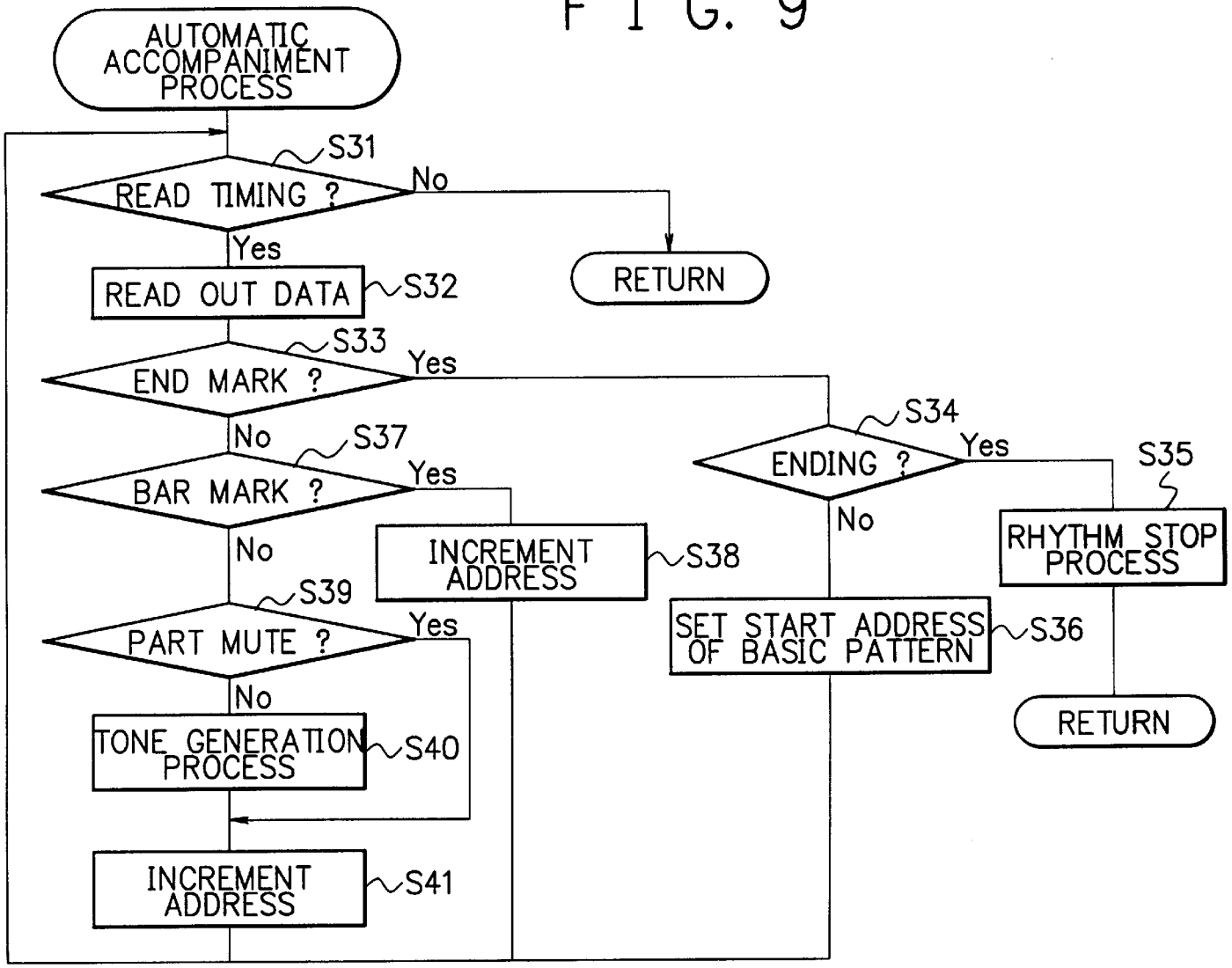
FIG. 9 is a flowchart showing an automatic accompaniment process executed by the automatic accompaniment apparatus according to the embodiment of the present invention.

FIGS. 7 to 9 are flowcharts showing operations of the automatic accompaniment apparatus according to this embodiment with the above arrangement. FIG. 7 is a flowchart showing the operation of a main routine. Referring to FIG. 7, the CPU 3 shown in FIG. 2 performs initialization in step S1. In this case, the CPU 3 clears the storage areas of the RAM 5, the tone generation channel assignments in the sound source 7, and the like.

Upon completion of initialization, the CPU 3 executes a panel process in step S2, and an automatic accompaniment process in step S3 in turn, and then executes another process in step S4. The flow then returns to step S2, and the CPU 3 repeats a similar loop process until the power switch of the automatic accompaniment apparatus is turned off.

In the panel process in step S2, the CPU 3 detects an operation event of the panel operation members 8 on the control panel 2, and executes a corresponding process. More specifically, the CPU 3 executes processes shown in the flow chart in FIG. 8. Referring to FIG. 8, the CPU 3 shown in FIG. 2 scans various operation members equipped on the control panel 2 to detect the presence/absence of an operation event of each operation member in step S11. If no operation event is detected, the control leaves this panel process.

On the other hand, if some operation event has taken place, the flow advances to step S12 to check if that event is an operation event of one of the variation switches 25, i.e., if the selection state of the variation pattern has been changed. If the selection state of the variation pattern has been changed, the flow advances to step S13 to set the number of a newly selected variation pattern in the RAM 5 (the storage area shown in FIG. 5B).

If the detected event is not an operation event of one of the variation switches 25, the flow advances to step S14 to check if that event is an operation event of the mute setting switch 23, i.e., if the first mute setup for changing the mute setup state of a given part of a certain variation pattern associated with one rhythm style has been made. If the first mute setup has been changed, the flow advances to step S15 to set a new mute setup state in the RAM 5 (the storage area shown in FIG. 5A, i.e., the mute memory 5*a* shown in FIG. 6).

Note that the mute setup state information set in the mute memory 5*a* is read out from the mute memory 5*a* and is set in the mute register 5*b* in accordance with a variation pattern of a desired rhythm style, which is selected upon starting to play automatic accompaniment later (not shown in the flow chart in FIG. 8).

If the detected event is not an operation event of the mute setting switch 23, the flow advances to step S16 to check if that event is a play start operation event by the start/stop switch 22. If the play start operation event has taken place, the flow advances to step S17, and the start address of automatic accompaniment data of the currently selected variation pattern is set in the RAM 5 or a register (not shown) or the like in CPU 3.

If the detected event is not a play start operation event, the flow advances to step S18 to check if the event is an insert pattern play start operation event by the introduction/ending switch 21 or one of the fill-in switches 24. If that event is an insert pattern play start operation event, the flow advances to step S19 to set the start address of automatic accompaniment data of the select insert pattern in the RAM 5 or a register (not shown) or the like in CPU 3.

Furthermore, if the event is not an insert pattern play start operation event, the flow advances to step S20 to check if that event is an operation event associated with the second mute setup by one of the part switches 26. If that event is an operation event associated with the second mute setup, the flow advances to step S21 to invert the LED state of one of the drum, bass, and chord part switches of the part switches 26 in accordance with the operation event. In step S22, the inverted new mute setup state information is set in the RAM 5 (mute register 5*b* in FIG. 6).

If the detected event is none of the aforementioned events, the flow advances to step S23 to execute another switch process corresponding to that operation event. After the process in one of steps S13, S15, S17, S19, S22, and S23, the control leaves this panel process.

The automatic accompaniment process in step S3 in FIG. 7 produces accompaniment tones on the basis of various automatic accompaniment pattern data stored in the automatic accompaniment memory 6. More specifically, processes shown in the flow chart in FIG. 9 are done. Note that the processes shown in FIG. 9 are independently done in units of drum, bass, and chord parts.

Referring to FIG. 9, the CPU 3 in FIG. 2 checks in step S31 if the read timing of automatic accompaniment data has been reached. Note that the read timing is appropriately controlled on the basis of the pattern, the rhythm style, the set tempo, etc., of the selected automatic accompaniment data.

If the data read timing has not been reached yet, the control exits the automatic accompaniment process; otherwise, the flow advances to step S32 to read out the currently addressed automatic accompaniment data from the automatic accompaniment memory 6. The CPU 3 checks in step S33 if the readout data is an end mark. If the readout data is an end mark, the flow advances to step S34.

The CPU 3 checks in step S34 if the currently selected pattern, which is to undergo automatic accompaniment, is an ending pattern. If YES in step S34, an automatic accompaniment stop process is executed in step S35, and the control leaves the automatic accompaniment process. On the other hand, if the currently selected pattern is not an ending pattern, the start address of automatic accompaniment data of the basic pattern (variation pattern) is set in the RAM 5 or a register (not shown) or the like in the CPU 3 in step S36 so as to restart the play from the beginning of that basic pattern. After that, the flow returns to step S31.

On the other hand, if it is determined in step S33 that the readout data is not an end mark, the flow advances to step S37 to check if the readout data is a bar mark. If the readout data is a bar mark, the address is incremented by "1" in step S38, and the flow returns to step S31. On the other hand, if the readout data is not a bar mark, since the readout data is note data, the flow advances to step S39.

The CPU 3 checks in step S39 with reference to the information, which is stored in the RAM 5 and pertains to the currently selected variation pattern and the mute setup states in units of parts of each pattern, if the part of interest is set in a mute state. If that part is not set in a mute state, an ordinary tone generation process is executed in step S40, and the address is incremented by "1" in step S41. The flow then returns to step S31. On the other hand, if that part is set in a mute state, the flow jumps to step S41 without executing the tone generation process in step S40.

As described above in detail, according to this embodiment, information indicating the currently selected variation pattern and indicating mute setup states of the individual parts of each variation pattern is stored in the RAM 5, and the tone generation states of the individual parts are controlled with reference to the information stored in the RAM 5 even when an insert pattern is selected. Hence, the mute setup states of the individual parts can be prevented from changing upon switching between the variation pattern and the insert pattern, and smooth automatic accompaniment tones can be obtained.

In particular, in this embodiment, when insertion of a fill-in pattern, which does not correspond to a given variation pattern that is being played, is instructed (e.g., VARI1→ one of FILL2 to FILL4), the fill-in pattern is played in accordance with the mute setup state of the originally selected variation pattern. Therefore, even when a variation pattern is switched to a fill-in pattern which does not correspond to that variation pattern, and vice versa, the mute setup states can be prevented from changing, and a smooth play can be attained.

In the above embodiment, the control is made to apply the mute setup states set in units of parts of each variation pattern to various insert patterns. However, the present invention is not limited to such a specific control. For example, since the volume, panpot (orientation of acoustic image), and the like, can be set in units of parts of each variation pattern, the above embodiment can be similarly applied to the setup states of these parameters.

What is claimed is:

1. An automatic accompaniment apparatus having a function of making automatic accompaniment of an insert pattern in addition to a basic pattern, comprising:

variation selection means for selecting desired one out of variation patterns to be played and prepared as said basic pattern;

mute setting means for individually setting a mute setup state of each part for each of said variation patterns;

instruction means for giving instructions to play said insert pattern;

control means for controlling to make each part in a tone generation state or a mute state in accordance with the mute setup state of the part of the selected variation pattern in playing said insert pattern; and wherein the control means interrupts playing the selected variation pattern to play said insert pattern and restarts the playing of the selected variation pattern once playing said insert pattern is complete.

2. An apparatus according to claim 1, further comprising storage means for storing at least information on the selection state of said variation patterns and the mute setup state of each part, wherein said control means controls tone generation of each part with reference to information stored in said storage means in receiving instructions to play said insert pattern.

3. The apparatus according to claim 1 wherein the instruction means further comprises giving instructions to play the variation pattern and to interrupt the play of the variation pattern when giving instructions to play the insert pattern.

4. The apparatus according to claim 1 wherein the instruction means further comprises giving instructions to play the variation pattern when the playing of said insert pattern is complete.

5. The apparatus according to claim 4 wherein said insert pattern is at least one of an introduction pattern and a fill-in pattern.

6. The apparatus according to claim 3 said insert pattern is at least one of a fill-in pattern and an ending pattern.

7. The apparatus according to claim 5 wherein the control means further makes each part in a tone generation state or a mute state in accordance with the mute setup state of a common part, in which the common part is a part of the variation pattern that corresponds to a part of the insert pattern.

8. The apparatus according to claim 6 wherein the control means further makes each part in a tone generation state or a mute state in accordance with the mute setup state of a common part, in which the common part is a part of the variation pattern that corresponds to a part of the insert pattern.

9. The apparatus according to claim 7 wherein the part is one of a drum, base and chord.

10. The apparatus according to claim 8 wherein the part is one of a drum, base and chord.

* * * * *